United States Patent [19]

Radtke et al.

[11] Patent Number: 4,468,908

[45] Date of Patent: Sep. 4, 1984

[54] PROCESS AND APPARATUS FOR PRODUCING A FLOOR-, WALL- OR CEILING SURFACE FORMED OF INDIVIDUAL ASSEMBLY PLATES AND PROVIDED WITH A COVERING

[75] Inventors: Wolfgang Radtke, Overath; Friedrich H. Schmidt; Fritz Reuter, both of Cologne; Walter Moog, Aachen-Richterich; György Borbely, Düsseldorf, all of Fed. Rep. of Germany

[73] Assignee: Schmidt Reuter Ingenieurgesellschaft mbH & Co. KG, Cologne, Fed. Rep. of Germany

[21] Appl. No.: 247,632

[22] Filed: Mar. 25, 1981

[30] Foreign Application Priority Data

Mar. 31, 1980 [DE] Fed. Rep. of Germany ..... 3012470

[51] Int. Cl.[3] ..... E04B 3/52

[52] U.S. Cl. ..... 52/483; 52/586; 52/811

[58] Field of Search ..... 52/392, 393, 586, 603, 52/811, 483, 506, 471, 533, 384, 385, 747, 312, 313, 126.6, 263; 404/74, 8, 43, 47, 49, 64, 69

[56] References Cited

U.S. PATENT DOCUMENTS

| | | | |
|---|---|---|---|
| 209,310 | 10/1878 | Wands | 52/533 |
| 1,840,974 | 1/1932 | Rockwell | 52/586 X |
| 2,045,382 | 6/1936 | Elmendorf | 52/586 |
| 3,239,986 | 3/1966 | Russell | 52/586 X |
| 3,381,436 | 5/1968 | Elliott et al. | 52/471 X |

FOREIGN PATENT DOCUMENTS

| | | | |
|---|---|---|---|
| 1347930 | 11/1963 | France | 52/385 |
| 1173665 | 12/1969 | United Kingdom | 52/126.6 |

*Primary Examiner*—Carl D. Friedman

*Attorney, Agent, or Firm*—Diller, Ramik & Wight

[57] ABSTRACT

This disclosure relates to floor, wall or ceiling construction which includes a pair of plates having top and bottom surfaces and a relatively long peripheral side surface therebetween, each peripheral side surface including a first surface portion immediately adjacent each associated top surface, the first surface portions being disposed in relatively closed spaced side-by-side relationship to collectively define therebetween a relatively narrow guide groove of a predetermined width for receiving therein a cutting tool and of a length corresponding to the length of the peripheral side surfaces, each first surface portion merging with a second surface portion, the second surface portions being disposed in comparatively further spaced side-by-side relationship and the first surface portion is to define therebetween a relatively laterally wider adhesive-receiving channel, a cover across the top surfaces of the plate in spanning relationship to the narrow guide groove, an adhesive between the cover and the top surface of the plates, and an abutment element positioned between the laterally wide channel and the bottom surfaces of the plates for maintaining the narrow guide groove at its predetermined width whereby upon the insertion of the cutting element into and through the covering and in and along the narrow groove adhesive is free to flow through the narrow groove and collect in the channel.

9 Claims, 8 Drawing Figures

PROCESS AND APPARATUS FOR PRODUCING A FLOOR-, WALL- OR CEILING SURFACE FORMED OF INDIVIDUAL ASSEMBLY PLATES AND PROVIDED WITH A COVERING

This invention relates to the production of a floor, wall or ceiling formed of individual plates and having adhesively bonded thereto a covering of hard or flexible material.

It is conventional to form a plurality of panels of a predetermined size, adhesively bond a covering of a larger size upon each panel and thereafter cut the coverings to the size of the panels or plates. Generally a large covering is adhesively bonded to a smaller plate or panel assembly and after the adhesive has set, the covering is simply cut to match the periphery of the assembly panel or plate. A plurality of such prefabricated panels can then be assembled upon a substrate to form a ceiling, floor, or the like. When the individual panels are assembled upon and secured to the substrate, one must, of course, take into account differences in the individual coverings as, for example, color differences, the direction of the pile when the coverings are carpeting, etc. Moreover, the edges of the plates and the covering can be damaged both during the fabrication thereof, including the bonding of the covering to the plate, and during the transport of the thus covered plates. Finally, inaccuracies in cutting the coverings if not cut straight will be readily detectable and reflected when such plates are positioned upon a substrate in side-by-side adjacent relationship to form an overall floor covering.

One alternative to forming plates with coverings adhesively bonded thereto in the manner just described is that of simply first placing a number of the plates upon a substrate and adhesively bonding a relatively large covering to all of the plates. However, if for some reason it was desired or necessary to remove one or more of the plates, such could not be done without in some fashion destroying the covering. If it were desired to remove a plate, one would have to somehow carefully guess where a particular plate is butted against an adjoining plate, insert a knife through the covering at the butt joint, and then attempt to effect an exact separation of the covering along the peripheral profile of the plate without excessive damage. The latter is virtually impossible, particularly when it is appreciated that the butt joint between the plates is generally filled with set adhesive which resists the motion of the cutting tool and prevents accurate (straight) or desired movement thereof along the covering. If the covering is made of flexible fibers, any such efforts at removing one of the plates by cutting through the textile fiber covering most assuredly runs the risk that the individual fibers are removed or torn from the covering thus impairing, if not destroying, both the functional and aesthetic qualities of the covering.

In view of the foregoing disadvantages of known systems of applying coverings to plates and/or larger areas, it is a primary object of the present invention to provide a novel floor, wall or ceiling by first assembling a plurality of plates in adjacent, though slightly spaced relationship, so that the edges of adjacent plates define narrow grooves which permit a cutting tool inserted through a covering atop the plates to be guided thereby. The groove progressively widens into a larger channel such that when adhesive is used for bonding the covering to the plates, any excess of such adhesive will simply flow into the larger chamber and will not adversely accumulate during the cutting operation or thereafter between the cut edges of the covering or between the edges of the groove. Thus, the groove is maintained free of adhesive so that, for example, connecting elements may be placed therein to connect the joining plates to each other. In addition, air can freely circulate through such grooves which would otherwise be precluded if they were filled with adhesive.

In further accordance with this invention, the adjacent plates are maintained with their edges in spaced relationship through the provision of abutment means positioned between and/or within the laterally wider channel, and the latter assures that the edges will not contact each other. Thus, due to the provision of the abutment means, the cutting tool can be inserted between the edges and, just as importantly, the adhesive can flow therethrough into the relatively laterally wider adhesive-collecting channel.

With the above and other objects in view that will hereinafter appear, the nature of the invention will be more clearly understood by reference to the appended claims and the several views illustrated in the accompanying drawings.

IN THE DRAWINGS

Figure 1:
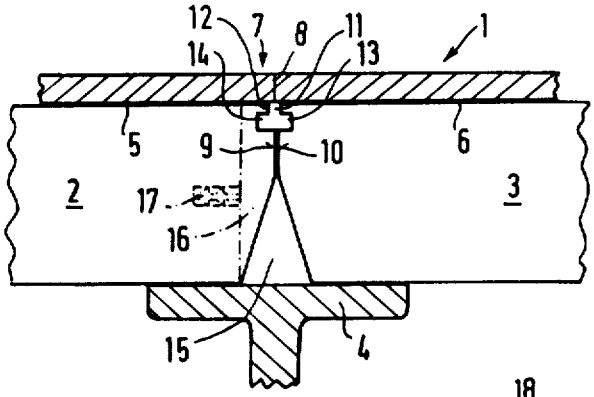
FIG. 1 is a fragmentary elevational view partially in section, and illustrates a first embodiment of the invention including a covering adhesively secured atop a pair of adjacent plates having spaced edges defining a cutting tool guiding groove and an adjacent laterally wider adhesive-receiving channel with abutment means immediately therebelow.

In accordance with the floor, wall or ceiling construction or embodiment 1 of FIG. 1, two adjacent and continuous assembly plates 2, 3 rest upon a support or beam 4. Upper surfaces 5, 6 of the assembly plates 2, 3 respectively, are provided with a continuous cover or covering 7 of soft or hard material which may be adhesively bonded to and atop the plates 2, 3.

The covering 7 is normally placed in spanning relationship to the plates 2, 3 and then is cut along a cut line 8 which also, of course, defines opposing edges of the cut covering 7.

The plates 2, 3 are preferably positioned so that edge portions 11, 12 therebetween are at all times maintained in spaced relationship and, hence, define a groove into which a cutting tool, such as a knife, can be inserted and thereby guided to form the cut 8. The edges 11, 12 are maintained in spaced relationship by abutment means in the form of abutment surfaces 9, 10 of the respective plates 2, 3 which simply are in abutting relationship and prevent the edges 11, 12 from contacting each other. However, between the edges 11, 12 and the abutment means 9, 10, each plate 2, 3 is provided with a respective groove 14, 13 with the grooves 14, 13 being in opposed relationship to define therebetween a relatively laterally wider adhesive-receiving channel 13, 14.

Below the abutment means or surfaces 9, 10, the sides of the plates 2, 3 are contoured to define a downwardly diverging free space 15.

The function of the individual grooves 13, 14 and collectively the channel 13, 14 defined thereby is to receive adhesive which may flow from between the upper surfaces (unnumbered) of the plates 2, 3 and the covering 7. The adhesive has a tendency to flow between the edges 11, 12 and if the adhesive were free to set-up therein, it would be impossible to form the cut 8 because a cutting tool or knife could not be inserted through the covering 7 and into the groove defined between the edges 11, 12. However, due to the laterally wider width of the adhesive-receiving channel 13, 14, the adhesive from between the covering 7 and the plates 2, 3 can freely flow into the channel 13, 14 can accumulate therein, and at the same time a cutting tool or a cutting knife can be drawn along the groove between the edges 11, 12 to form the accurate cut 8 thus presenting an aesthetically acceptable appearance in the covering 7 when viewed from above.

Figure 2:
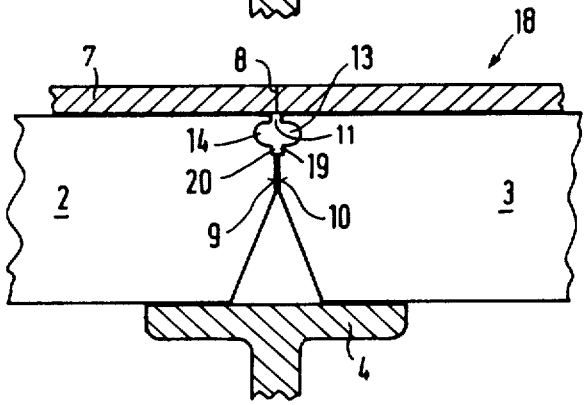
FIGS. 2 through 8 are fragmentary schematic views partially in section, and illustrates further embodiments of the present invention.

The construction 18 of FIG. 2 is essentially identical to that shown in FIG. 1 with the exception of the grooves 13, 14 being generally curved in transverse cross-section and located between the grooves 13, 14 and the abutment means or surfaces 9, 10 are lateral edge portions or grooves 19, 20. The edge portions 19, 20 form a groove corresponding in narrow width to the groove 11, 12 of FIG. 1 and, thus, a cutting tool can be inserted not only through the covering to form the cut line 8 of FIG. 2 but also into the groove at 19, 20 to provide additional guidance during a cutting operation.

Figure 3:
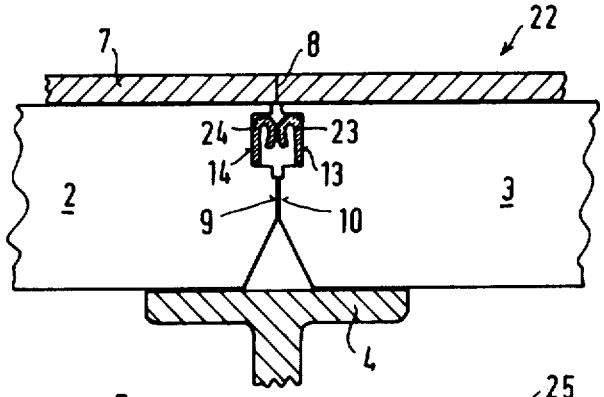

The construction 22 of FIG. 3 corresponds to that shown in FIG. 2 on a slightly enlarged scale but added thereto are a pair of sealing elements 23, 24 retained within the respective grooves 13, 14. The sealing elements 23, 24 are preferably each designed as a resilient ceiling lip. Of course, it is possible to form the sealing elements 23, 24 as a single sealing element so long as the material can be cut by a cutting tool during the formation of the cut 8 when cutting the covering 7. Whether there be two sealing elements 23, 24 or a single sealing element which is essentially split into , it is essential in accordance with this invention that the seal be such that air below the sealing element 23, 24 can not pass upwardly therethrough and pass through the slit or cut 8 since this would separate the latter and the same would become highly visible.

Figure 4:
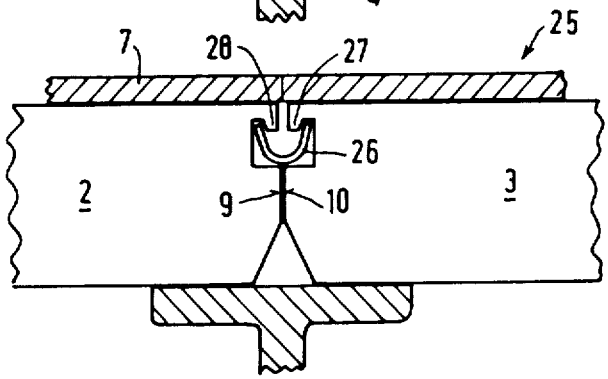

In the construction 25 of FIG. 4, a connecting element 26 is provided in spanning relationship relative to the plates 2, 3 and within the groove (unnumbered) corresponding to the grooves 13, 14 of the preceeding embodiments. In this case the plates 2, 3 have depending noses 28, 28, respectively, which frictionly engage the connecting element 26 and thus maintain the plates 2, 3 in adjacent assembled relationship. The connecting element 26 may also be electrically conductive to permit an electrical connection from one assembly plate 2, 3 to the other.

Figure 5:
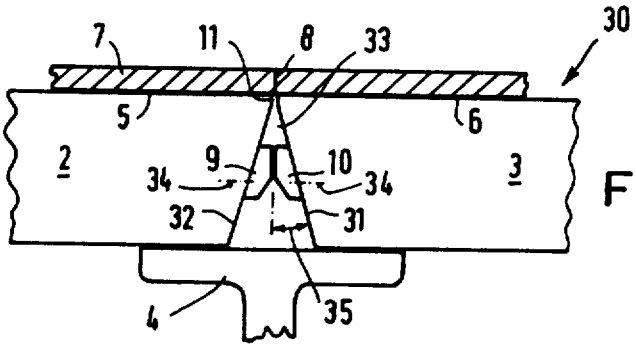

The construction 30 of FIG. 5 includes lateral sides or edges 31, 32 which diverge in a direction downwardly from the groove 11. The lateral divergence creates a laterally enlarged adhesive-receiving channel 33 immediately below the narrower guidance groove 11. Furthermore, projecting elements or abutment means 9, 10 project beyond the diverging surfaces 31, 32 but still function to maintain the plates 2, 3 spaced to define the narrow groove 11 into which the cutting tool can again be positioned to form the slit or cut 8. Preferably, the inclination to the vertical between each of the edges 31, 32, as indicated by reference numeral 35, is an angle of at least about 12 degrees to 15 degrees and greater, and this relationship is maintained by suitable conventional fixing or connecting means 34, 34.

Figure 6:
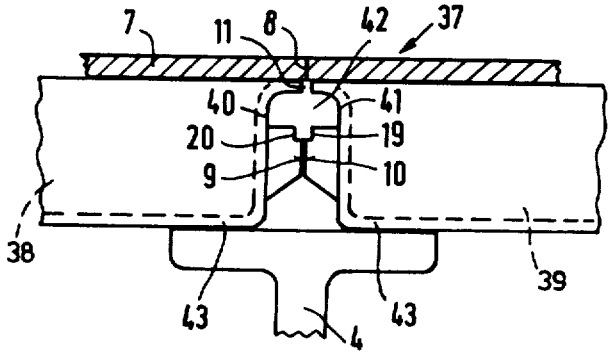

The construction 37 of FIG. 6 includes a pair of plates 38, 39 which are so designed as to have lateral edges or surfaces 40, 41 which form a relatively large arc or curve to form an adhesive-receiving groove or channel 42 between the narrower groove 11 and a similarly narrow groove spaced from but vertically aligned with the groove 11, as defined by the grooves 19, 20 of abutment means 10, 9, respectively. The abutment means 9 and 10 can be secured to the assembly plates 38, 39, respectively, as independent menbers and, if desired, each of the plates 38, 39 can be fitted with a sheath jacket 43.

Figure 7:
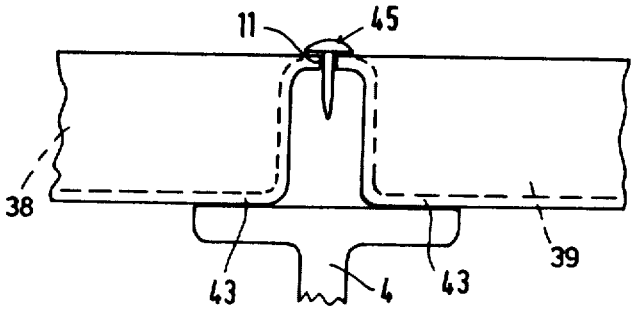

The construction of the invention shown in FIG. 7 simply includes one or more spacers 45 which are received within the groove 11 between assembly plates 38, 39 and, thus, define the equivalent of the abutment means 9, 10 of FIG. 1 through 6. However, in this case the spacers or abutment means 45 must be removed prior to the application of adhesive to the upper surfaces of the plates 38, 39 and eventually the positioning of a covering (not shown) thereupon. However, a knife or cutting tool can be inserted through such covering and within the groove 11 to form a cut covering but, of course, during this operation there is nothing to assure that the plates 38, 39 will not move relatively closer to each other.

Figure 8:
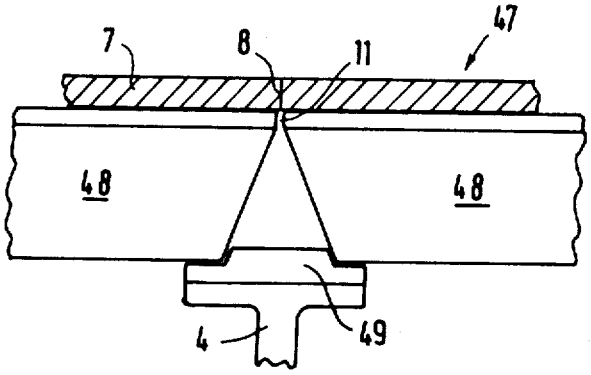

The final construction 47 shown in FIG. 8 simply includes as the abutment means a separate element 49 carried by a support 4 though positioned between the plates 48, 48.

In the constructions heretofore described, the various plates are all contoured to form the opposing edges 13, 14 or grooves 13, 14 or 11 with an enlarged adhesive-receiving channel 13, 14, 33, 42, etc., immediately therebeneath. Furthermore, in all but the construction of FIG. 7, suitable abutment means 9, 10 or 49 are provided to assure that the groove or channel 13, 14, 11 is maintained at a predetermined dimension to assure that the cutting tool can be guided to thus accurately form the cut 8 of the covering 7. It is, of course, possible to provide variations in the structure and all such variations are considered to be within the scope of this disclosure and the claims appended hereto.

What is claimed is:

1. A floor, wall or ceiling construction comprising first and second individual plates disposed adjacent each other and each having top and bottom opposite surfaces and a relatively long peripheral side surface therebetween, each peripheral side surface including a first surface portion immediately adjacent each top surface, said first surface portions being disposed in relatively close spaced side-by-side relationship to collectively define therebetween a relatively narrow guide groove of a predetermined width for receiving therein a cutting tool, said narrow guide groove being of a length corresponding to the length of said peripheral side surfaces, each first surface portion merging with a second surface portion, said second surface portions being disposed in comparatively further laterally spaced side-by-side relationship than said first surface portions to define therebetween a relatively laterally wider channel than the width of said narrow guide groove, covering means for covering said top surface of each plate in spanning relationship to said narrow guide groove, an adhesive between said top surface and said covering means, abutment means positioned between said laterally wider channel and said bottom surface for maintaining said first surface portions in said spaced side-by-side relationship whereby, upon inserting a cutting element through said covering means and into and along said narrow guide groove, adhesive between said covering means and said top surface can freely pass through said narrow guide groove and collect within said relatively laterally wider channel.

2. The floor, wall or ceiling construction as defined in claim 1 wherein said abutment means includes separate removable abutment surface means disposed along each said second surface portions for abuttingly contacting each other thereby maintaining said first surface portions in spaced relationship.

3. The floor, wall or ceiling construction as defined in claim 1 wherein said abutment means includes integral homogeneous abutment surface means disposed along each said second surface portions for abuttingly contacting each other thereby maintaining said first surface portions in spaced relationship.

4. The floor, wall or ceiling construction as defined in claim 1 wherein said second surface portions set-off therebetween an included angle of at least 30 degrees or greater.

5. The floor, wall or ceiling construction as defined in claim 1 including sealing means in said laterally wider channel for precluding the flow of air therethrough.

6. The floor, wall or ceiling construction as defined in claim 1 including an electrically conductive element housed in said laterally wider channel.

7. The floor, wall or ceiling construction as defined in claim 1 including a second guide groove opposite to and generally aligned with said first-mentioned guide groove opening into said laterally wider channel whereby a cutting element can be additionally guided by said second guide groove.

8. The floor, wall or ceiling construction as defined in claim 1 including mechanical interlocking means disposed generally in said laterally wider channel and spanning said guide groove for interlockingly uniting said individual plates.

9. The floor wall or ceiling construction as defined in claim 1 including means for supporting said individual plates through said bottom surfaces thereof, said supporting means in part defining said abutment means, and said abutment means including abutment surface means disposed along said supporting means abuttingly contacting said second surface portions thereby maintaining said first surface portions in spaced relationship.

* * * * *